US007918767B1

(12) United States Patent
Wilson

(10) Patent No.: US 7,918,767 B1
(45) Date of Patent: Apr. 5, 2011

(54) EXERCISE APPARATUS

(76) Inventor: Alan Clifford Wilson, Denver, CO (US)

( * ) Notice: Subject to any disclaimer, the term of this patent is extended or adjusted under 35 U.S.C. 154(b) by 0 days.

(21) Appl. No.: 12/576,218

(22) Filed: Oct. 8, 2009

(51) Int. Cl.
*A63B 22/02* (2006.01)
*A63B 23/14* (2006.01)

(52) U.S. Cl. ..... 482/54; 482/45; 482/92

(58) Field of Classification Search ..... 482/51, 482/54, 148, 44–46, 110, 112, 114, 115, 482/118, 119, 136, 139, 92
See application file for complete search history.

(56) References Cited

U.S. PATENT DOCUMENTS 4,293,127 A * 10/1981 Dudley ..... 482/120
4,625,962 A * 12/1986 Street ..... 482/116
4,979,733 A * 12/1990 Prud'Hon ..... 482/4
5,171,196 A * 12/1992 Lynch ..... 482/7
5,254,064 A * 10/1993 Rock ..... 482/126
5,605,521 A * 2/1997 Hsieh ..... 482/51
5,681,244 A * 10/1997 Hsieh ..... 482/51
6,022,303 A * 2/2000 Abdo ..... 482/140
6,042,516 A * 3/2000 Norton ..... 482/54
6,723,028 B1 * 4/2004 Wang et al. ..... 482/54
7,575,537 B2 * 8/2009 Ellis ..... 482/54
7,641,597 B2 * 1/2010 Schmidt ..... 482/51
7,722,507 B2 * 5/2010 Yoo ..... 482/54
2006/0035757 A1 * 2/2006 Flick et al. ..... 482/54
2007/0287601 A1 * 12/2007 Burck et al. ..... 482/54
2008/0081745 A1 * 4/2008 Sargen et al. ..... 482/98
2008/0287267 A1 * 11/2008 Ellis ..... 482/54

* cited by examiner

*Primary Examiner* — Steve R Crow
(74) *Attorney, Agent, or Firm* — Roger A. Jackson

(57) ABSTRACT

The current invention is an exercise apparatus and method adapted for use with a leg exercising machine, the exercise apparatus including a base, a support beam having a proximal end and a distal end, wherein the proximal end portion extends from the base. Further included in the exercise apparatus is an omni-directional movable joint element that is disposed adjacent to the distal end portion and a grasping arm, with the grasping arm being received within the omni-directional movable joint element, wherein the grasping arm is operational to have omni-directional movement relative to the support beam. Also included in the exercise apparatus is a dampening element that is disposed between the support beam and the grasping arm, the dampening element is operational to dampen the omnidirectional movement such that an individual using the leg exercising machine can grasp the arm for stability and support for a soft skeletal joint support.

17 Claims, 12 Drawing Sheets

| Dampening Test Data | | | | |
|---|---|---|---|---|
| | Treadmill Speed (mph) ( ) | Force (lbs.) ( ) | Movement–max (inches) ( ) | Time (seconds) ( ) |
| | 3 | 34–38 (36 avg.) | 0.5–1.5 (1.0 avg.) | 0.5/0.3/0.3 (0.37 avg.) |
| | 4 | 38–43 (41 avg.) | 2.5–3.5 (3 avg.) | 0.3/0.3/0.3 (0.3 avg.) |
| | 5 | 50–55 (53 avg.) | 3–4 (3.5 avg.) | 0.2/0.2/0.2 (0.2 avg.) |
| | 6 | 60–70 (65 avg.) | 3–4 (3.5 avg.) | 0.2/0.1/0.1 (0.13 avg.) |
| Aggregate Mean | 4.5 | 48.75 | 2.75 | 0.25 |

Fig.9

EXERCISE APPARATUS

TECHNICAL FIELD

The present invention generally relates to an apparatus for accomplishing exercise typically in a traditional exercise or working out environment, either in the home or commercial gym. More particularly, the present invention is an exercise apparatus that is adapted to be adjacent to a common treadmill that an individual uses in a home or commercial gym environment to facilitate exercise in a convenient time and place, thus allowing the individual to enjoy the health benefits of exercise when circumstances don't readily allow for the time and expense of exercising in an outdoor environment, such as running, bicycling, and the like, as opposed to using a traditional exercise facility, such as a gym, health club, spa, and so forth.

BACKGROUND OF INVENTION

The health benefits of exercise are well known and applicable to all ages of individuals, including cardiovascular improvement, muscle strengthening, stretching, increased blood circulation, better coordination, sharper motor abilities, flexible joint mobility, bone health, general overall wellness, and the like. One problem as an individual typically moves from being a child to being an adult, their physical activity levels decline just when maintaining good health is at its most important as an individual ages, typically their exercise levels decline that can work against maintaining good health, thus just when an individual should be exercising and being active, their exercise and activity levels tend to decrease.

Children are normally active in going places (i.e. walking or riding a bike), playing active games in their spare time, such as football, soccer, baseball, tag, hide and seek, and the like, plus being in school children are also active in physical education classes and after school hours sports leagues. Thus as children we are normally plenty active and in the best of health due to our young age. However, as we become adults, societal norms tend to drive us into a much more sedentary lifestyle, for instance by having a car, we tend to walk very little, nor ride a bicycle much, and as an office worker we tend to sit at a desk for long periods of time, sit in meetings, sit on airplanes, and then go out for high fat and calorie content meals at high end restaurants, thus as a result most adults tend to gain weight by consuming more calories coupled with a lower activity lifestyle, just when our bodies should be in better shape to compensate for aging we typically get in worse shape.

Although the benefits of exercise especially for adults are acknowledged by most everyone for weight control, maintaining agility, preventing diabetes, preventing joint stain from excessive body weight, preventing higher various internal organ workloads (especially the heart) from excessive body weight, and so on, few adults are active enough to maintain even a recommended weight, typically being only about one-fourth of the adult population is not overweight, thus an overwhelming majority of adults are overweight. So the question to ask is, why don't the majority of adults exercise especially if the health benefits are widely known?

One probable answer is that available time and convenience are a problem for engaging in an exercise program, as most adults have a full time job, a family, and other interests that all together consume most of an adult's time, this is in addition to boredom and the constant obligation of regular exercise placed upon an individual's time. Wherein, even the adults who engage in exercise programs, especially after new years in January—typically lose interest in a short amount of time, wherein this "petering-out" of individual's exercise program is acerbated by the long term slow rate of actual physical shape (endurance, strength, and appearance) improvement. Thus, a potentially helpful solution is to minimize the time, boredom, and convenience obstacles to allow for an exercise program to be more possible for a working adult on a long term basis.

In looking at the prior art in this area of exercise machines that attempt make exercise or physical rehabilitation easier, more effective, involving additional muscles, or less strenuous, for example in U.S. Pat. No. 6,450,923 to Vatti disclosed is an apparatus and methods for enhanced exercises and back pain relief, thus helping to decrease exercise boredom and increase comfort. People suffering from back pain in Vatti would be able to use the apparatus more effectively to relieve the pain. This apparatus in Vatti can also be used by common users for strengthening and stretching exercises that conventional exercising equipment such as treadmills do not provide. Combinations of a general frame in Vatti along with multiple attachments form an effective exercising apparatus. The user of the Vatti apparatus shifts weight from the spine or lower back to the hands while performing exercises.

Wherein, an ordinary upright user position causes more stress on the lower back and the weight of the upper body in motion may make the situation worse, say for instance on a typical treadmill. By suitable placement of hands and selectively distributing upper body weight to hands in Vatti, the user would be able to control the amount of weight reduction on the lower back or spine as needed to achieve the best results and comfort. Basically, Vatti combined a conventional treadmill with a number of attachments for exercising a user's arms and legs for additional exercises plus having upper body support while on the treadmill, however, not teaching any specifics related to adjustment or criterion setting, i.e. amount of upper body support.

Continuing in this area of exercise machine prior art, in U.S. Pat. No. 5,662,560 to Svendsen, et al., disclosed is a therapeutic bilateral weight unloading apparatus which suspends a user to support a selected portion the user's weight while reducing and dampening both vertical and lateral forces that are exerted on the user while standing or exercising. The apparatus in Svendsen, et al., suspends the user between two independently supported boom arms, with the independent action of the boom arms gently counter balances the user's natural weight shifts to reduce and dampen both the vertical and lateral forces exerted on the suspended user while standing or exercising, thus the dampening is applied to the entire user's body from a torso stabilizing harness.

The unloading apparatus Svendsen, et al., includes a frame and two pivoting boom arms that are independently supported by two gas compression springs with the user being completely suspended between the boom arms by a body harness. The boom arms Svendsen, et al., are pivotally connected to a vertically adjustable gantry frame extensibly mounted to a base frame, which allows the boom arms to be raised and lowered. The gas springs Svendsen, et al., provide the upward suspension force used to support a selected portion of the user's weight, further one end of the gas springs is connected to a slide collar shiftably mounted to each of the boom arms. Each slide collar Svendsen, et al., can be selectively positioned along the length of the boom arm to adjust the suspension force for each boom arm, in addition, the base frame may be fitted with casters, which allows the apparatus to be moved by the suspended user, see column 1, lines 43-67.

Svendsen et al., has disadvantages in requiring a user fitted unique harness, plus the discomfort from heavy physical activity, i.e. sweating/chaffing while the user is in the harness, as basically Svendsen, et al., is specifically designed for the user who needs total vertical support while on a treadmill for instance, in other words the user could completely collapse in Svendsen, et al., apparatus and still be completely suspended above the treadmill. Also, as in Vatti, there is no teaching in Svendsen, et al., related to adjustment or criterion setting, i.e. amount of upper body support.

Continuing in this prior art area in U.S. Pat. No. 5,372,561 to Lynch being configured similar to Svendsen et al., Lynch discloses an apparatus for whole user body suspension assisted ambulation to provide a vertically moveable gantry frame in conjunction with a treadmill with attachment points on the gantry frame which allow attachment of an upper-body harness so as to suspend a person so that the person can ambulate with less than gravitational weight on their lower extremities. The exercising device in Lynch comprises a treadmill, a vertical support frame affixed to such treadmill, a gantry frame pivotally attached to the vertical support frame, and an upper-body harness suspended from solid gantry frame; see column 2, lines 47-68. Pneumatic linear actuators are pivotally connected to Lynch in the vertical support frame and the gantry frame and regulated air pressure may be introduced into the pneumatic linear actuators to effect a rotational movement to the gantry frame in relation to the support frame and thus exert an upward force on the upper-body harness.

The magnitude of the vertical force in Lynch exerted on the upper-body harness is a function of the regulated air pressure. By regulating the air pressure in Lynch the user/operator can vary the uplift force applied to meet the requirements of each subject so that individuals who only need to be stabilized can ambulate with near full weight on their feet and where individuals who cannot tolerate full weight on a lower extremity joint may have the joint load reduced by a substantial percentage of their body weight. The use of air pressure in Lynch to actuate the upper-body suspension system allows it to instantly adjust to the vertical translational excursion of the body that occurs during ambulation and thus preclude oscillating shocks being induced to the user.

The control in Lynch of the various parameters of the machine, (belt speed, uplift force, and time) are preferably controlled, monitored and recorded by a computer, see column 3, lines 1-28. Lynch, does finally get into some criterion for upward force on the user's body through the use of regulating air pressure, however, there is a lack of specifics as to what relationship the upward force to have to other parameters of user weight, speed, condition, support type, etc, instead there are just a set of typical or arbitrary percentages of upward force, see column 6, lines 16-36. Further, in Lynch the use of air pressure in a cylinder is not good design, as the ability hold a position of the harness and thus upward force is unreliable due to air leakage and not having a positive suspension lock, i.e. a screw block type, plus if the compressor were to fail, the user would be suddenly dropped, potentially causing injury. Note that Lynch supports the entire user's body through a torso harness also much like Svendsen et al., not allowing for a contemporaneous dampened grasp by the user.

Further continuing in this prior art area U.S. Pat. No. 5,273,502 to Kelsey, et al. again is a harness type support for the entire user's body weight, see Lynch and Svendsen et al., in Kelsey et al., disclosed is a therapeutic apparatus and method including a frame to which a winch is mounted. A spring in Kelsey, et al., is attached at one end to the winch and at the other end to a support harness; also a load cell is connected to the winch so that the winch automatically maintains a set load while the load varies back and forth from more than to less than the set load. Cables interconnect the winch, spring and harness in a preferred embodiment in Kelsey, et al. Further, the support frame in Kelsey, et al. is preferably comprised of a pair of oppositely positioned strength beams, wherein these beams are interconnected by means of a transverse support within which is an opening from which the harness cable descends so that when a user wears the harness the user is supported from the transverse support from above; see column 2, lines 6-22.

The support harness in Kelsey, et al. includes a waist encircling abdominal strap that "grasps" the user very snugly so that there is no shifting of the abdominal strap as strain is taken on the support cable, i.e. as the user is "unloaded." A pair of arm loops in Kelsey, et al. is attached at opposite sides to the waist encircling abdominal strap and from those arm loops a corresponding pair of harness cable connectors is attached and these two connectors are attached to a single harness bar at the bar's opposite ends. The center of the bar is connected to the harness cable at the mid-point of the bar so that as the user is "unloaded," weight is lifted evenly on both sides of the user through the encircling abdominal strap, as a result the user is lifted precisely, evenly, and accurately, see column 2, lines 37-50. Kelsey et al., through the use of a kinematic system including a magnetic clutch and low spring constant change spring attempts to have a constant upward force exerted upon the user in a physical rehab type environment, although this system would seem to have a "pogo-stick" effect by not having any dampening, i.e. constantly yanking the user up and down due to reactionary changes in the winch movement that are amplified by the clutch and spring, i.e. leading to undesirable mechanical dynamic resonance of the system that would be discomforting to the user by being continually oscillating vertically.

Nest, in the exercise machine arts for a combination of exercise movements in U.S. Pat. No. 5,171,196 to Lynch discloses the dispensing of the user harness, that the previous Lynch '561 had, wherein Lynch '196 discloses a treadmill with variable upper body resistance loading to provide two, or more, sets of upper body exercising levers, in conjunction with an inclinable treadmill, each set of levers being independently moveable and with independently variable resistance from the other, note that this is resistance and not dampening, see column 1, lines 54-68. The first set of handlebars in Lynch '196 are placed at about waist height and the second set is placed at a height which would be about shoulder height or higher, furthermore, the upper set of handlebars enables the operator to lift the load by pushing in an upward position (pressing) as opposed to lifting or pulling upward which is done with the lower set of handlebars. Means in Lynch '196 are also provided to prevent the handlebars from dropping below essentially a horizontal position. In Lynch '196, hydraulic/pneumatic cylinders, springs, elastic bands or other suitable devices may be used as the resistance means and are selectively variable for both the upper and lower sets of levers independently, see column 2, lines 24-36. Primarily designed to be used in a weightless environment the multiple handlebar sets in Lynch '196 are operational to provide resistance through cylinders 60, 62, 94, and 96, however, as in Lynch '561 the exercise criterion are arbitrary as opposed to experimental relationships tied to definitive results, also there is no dampening disclosed for a grasp by the user.

There exists a need to provide an exercise apparatus that can facilitate the dynamically selective loading/unloading of the user's static and dynamic weight load force placed upon their back, legs, and feet. This would entail an added feature to a treadmill for example, however, not being limited to just a treadmill with any type of lower body portion exercise machine could be utilized as well, wherein a grasping element would be available to the user for instantaneously adjusting the load split as between their upper and lower body portions while using the exercise machine. Furthermore, it would be desirable for the grasping element to have a dampening feature to allow limited movement in a controlled manner of the grasping element to soften the impact load upon the physical skeletal structure and joints of the user's upper body portion. In summary, the primary feature would be to allow the user of the exercise machine, preferably a treadmill to use the grasping element at will and to also vary the amount of force loading split as between the user's upper and lower body portion, or to have no split in loading at all as between the upper and lower body portions, also at will.

SUMMARY OF THE INVENTION

The current invention is of an exercise apparatus that is adapted for use with a leg exercising machine on a surface, with the exercise apparatus including a base, a support beam having a longitudinal axis, with the support beam including a proximal end portion and an opposing distal end portion with the longitudinal axis disposed between the proximal and distal end portions, wherein the proximal end portion extends from the base. Further included in the exercise apparatus is an omni-directional movable joint element that is disposed adjacent to the distal end portion of the support beam and a grasping arm having a lengthwise axis, with the grasping arm being received within the omni-directional movable joint element. Wherein, the grasping arm is operational to have omnidirectional movement relative to the support beam.

Also included in the exercise apparatus is a dampening element that is disposed as between the support beam and the grasping arm, wherein the dampening element is operational to dampen the omnidirectional movement as between the grasping arm and the support beam such that an individual using the leg exercising machine can grasp the arm for stability and support to effect a soft skeletal joint support that is variable at will.

BRIEF DESCRIPTION OF DRAWINGS

FIG. 9 is a raw data chart for test data utilizing the treadmill with the same user at various treadmill moving surface speeds, wherein viscous dampening coefficient component data was taken for the three attributes of force to move the arm, distance that the arm moves, and the amount of time it takes the arm to move the specified distance;

REFERENCE NUMBERS IN DRAWINGS

Figure 1:
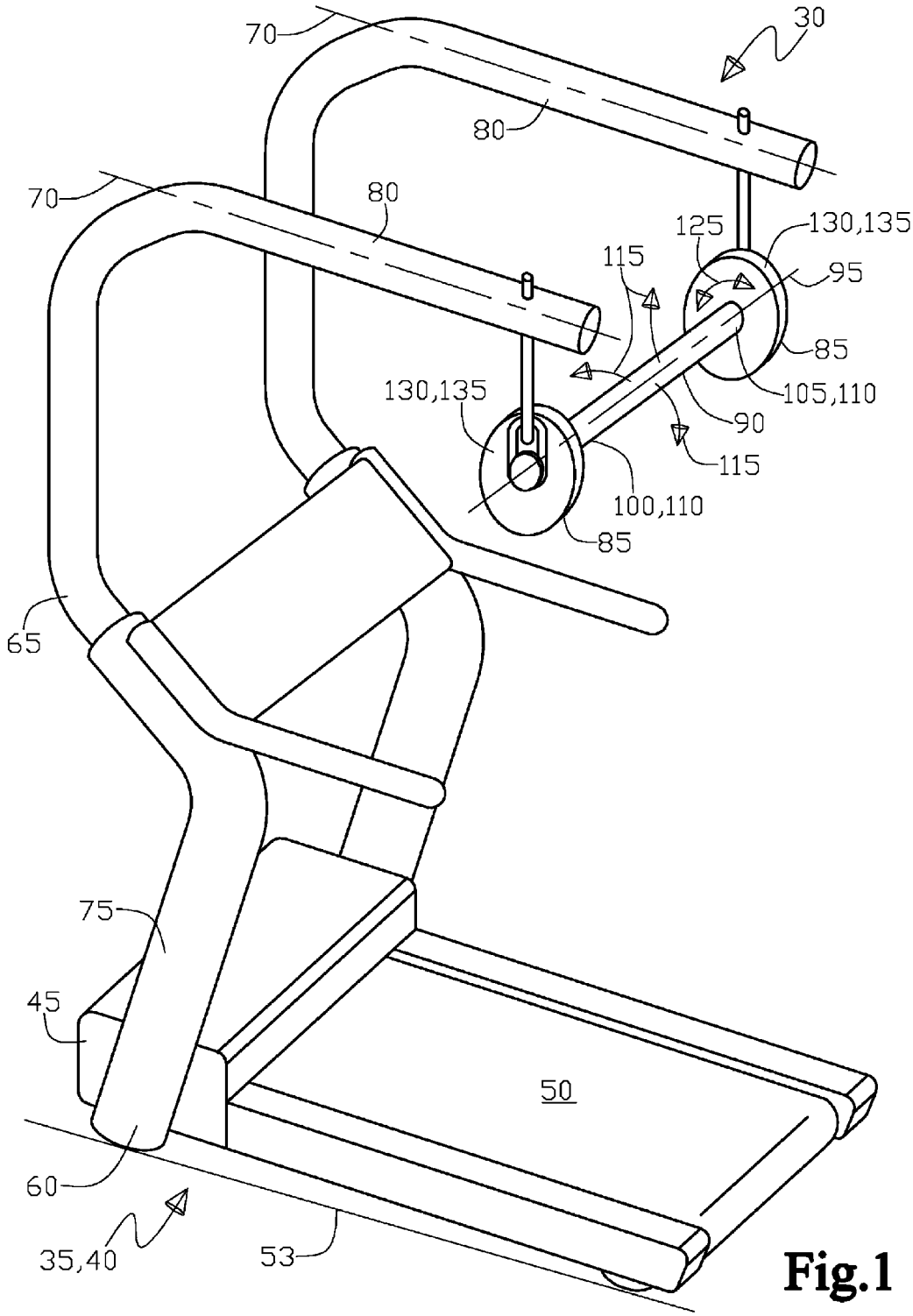
FIG. 1 is a perspective view of the exercise apparatus that is adapted to provide specific dampened overhead grasping support for a user of a treadmill.

30 Exercise Apparatus
35 Leg exercising machine
40 Treadmill apparatus
45 Treadmill frame
50 Treadmill moving surface
55 Surface
60 Base
65 Support beam
70 Longitudinal axis of the support beam 65
75 Proximal end portion of the support beam 65
80 Distal end portion of the support beam 65
85 Omnidirectional movable joint element
86 Disc of the omnidirectional movable joint element 85
90 Grasping arm
95 Lengthwise axis of the grasping arm 90
100 End portion of the grasping arm 90
105 Opposing end portion of the grasping arm 90

110 Receiving end portions of the grasping arm 90 within the omnidirectional movable joint element 85
115 Omnidirectional movement of the grasping arm 90
120 Grasping the grasping arm 90 for an overhead grasping support
125 Rotating movement of the grasping arm 90 about the lengthwise axis 95
130 Dampening unit for dampening rotational movement 125 about the lengthwise axis 95 of the grasping arm 90
135 Dampening element for dampening omnidirectional movement 115 of the grasping arm 90
140 Compressing force of dampening element 135
145 Plurality of surfaces of dampening element 135
150 Relative movement of the plurality of surfaces of dampening element 135
155 Sacrificial friction disc of dampening element 135
160 Hard disc of dampening element 135
165 Spring element of dampening element 135
170 Selectively adjustable spring element of dampening element 135
175 Selectively variable compressing force of dampening element 135
180 Dynamic coefficient of friction of dampening element 135
185 Piston of dampening element 135
190 Cylinder of dampening element 135
195 Restriction orifice of dampening element 135
200 Selectively variable restriction orifice of dampening element 135
205 Flow of fluid through the orifice 195 or 200 of dampening element 135
210 Movement of the piston 185 in relation to the cylinder 190 of dampening element 135
220 Movement of the piston 185 axially in relation to the cylinder 190 of dampening element 135
225 Movement of the piston 185 radially in relation to the cylinder 190 of dampening element 135
230 Plurality of piston 185 and cylinder 190 arrangements of dampening element 135
235 Means for urging the grasping arm 90 to a centered operational state
240 Elastomeric element for the means 235
245 Individual
250 User

DETAILED DESCRIPTION

Figure 2:
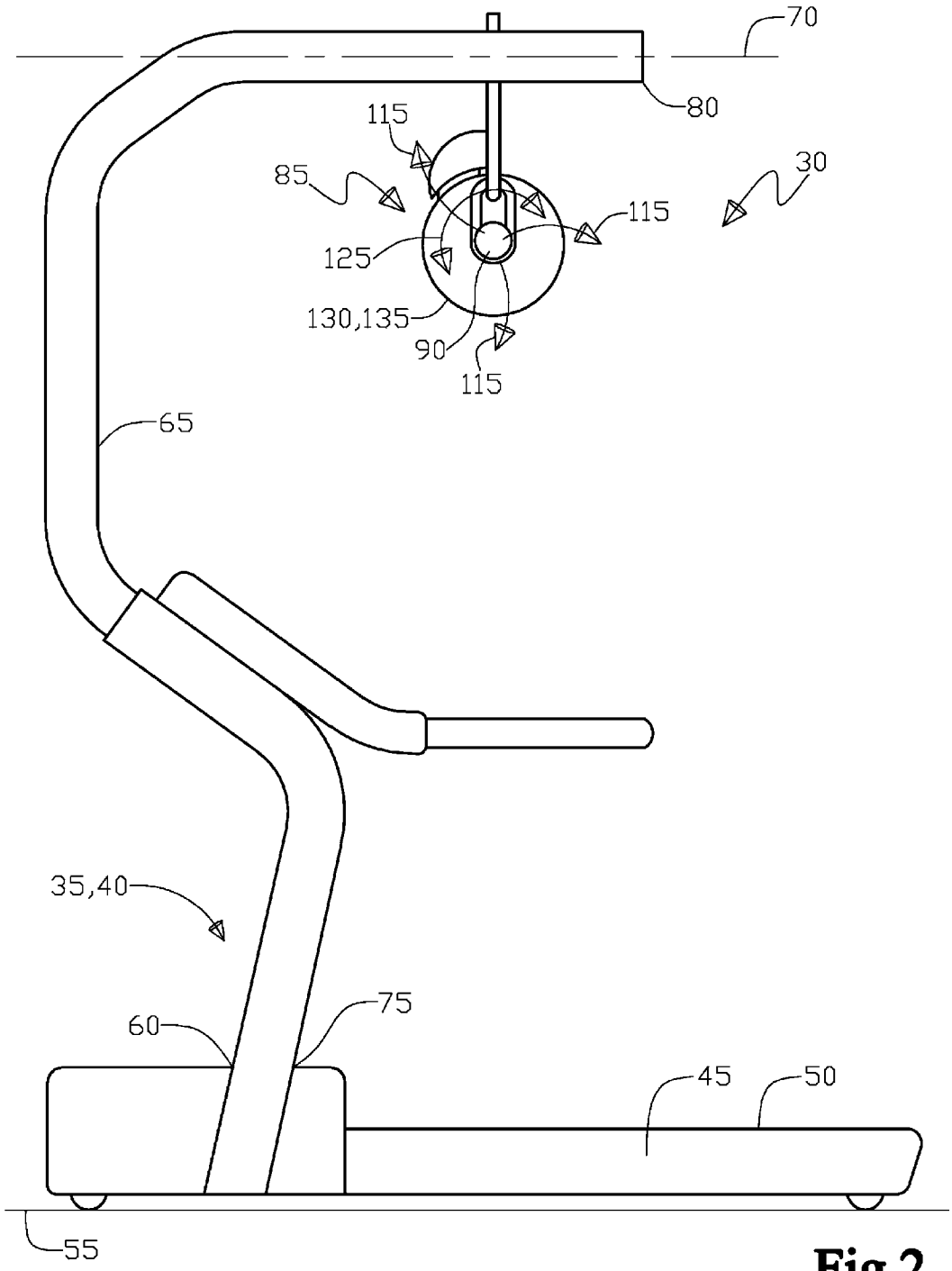
FIG. 2 is an elevation view of the exercise apparatus showing the treadmill, support beams, omnidirectional movable joint element, and the grasping arm.
Figure 3:
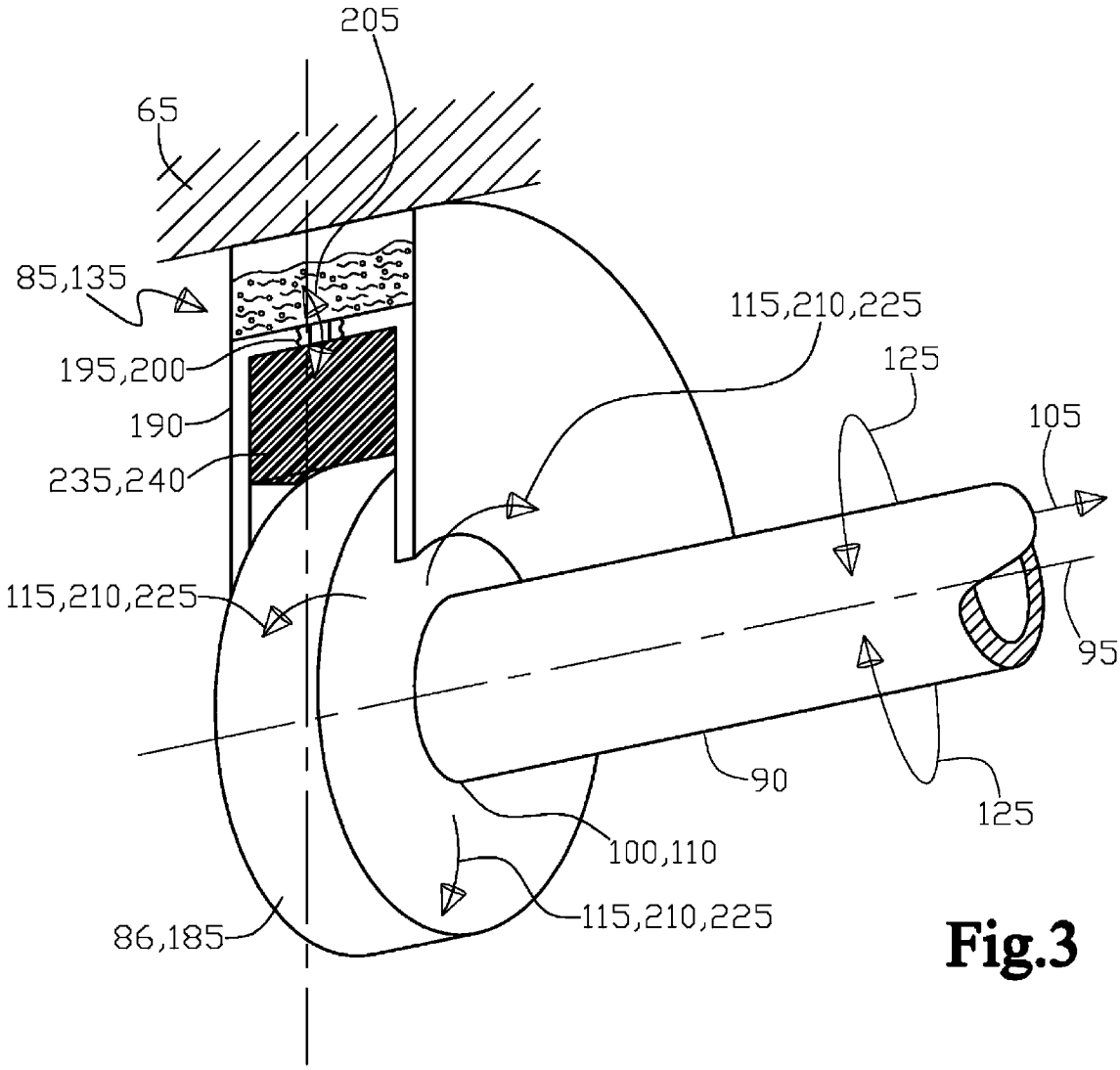
FIG. 3 is an expanded cross sectional view of the omnidirectional movable joint element that utilizes the optionally selectable dampening element of the radial movement piston within the cylinder in addition to the elastomeric material for the means for urging the grasping arm into a centered operational state, wherein dampening is provided for the omnidirectional movement, however, not the rotational movement.

With initial reference to FIG. 1 shown is the perspective view of the exercise apparatus 30 that is adapted to provide specific dampened overhead grasping 120 support for a user 250 of a treadmill 40 and FIG. 2 is an elevation view of the exercise apparatus 30 showing the treadmill 40, support beams 65, omnidirectional movable joint element 85, and the grasping arm 90. Next, FIG. 3 is an expanded cross sectional view of the omnidirectional movable joint element 85 that utilizes the optionally selectable dampening element 135 of the radial movement 225 piston 185 within the cylinder 190 in addition to the elastomeric material 240 for the means 235 for urging the grasping arm 90 into a centered operational state, wherein dampening is provided for the omnidirectional movement 115, however, not the rotational movement 125.

Figure 4:
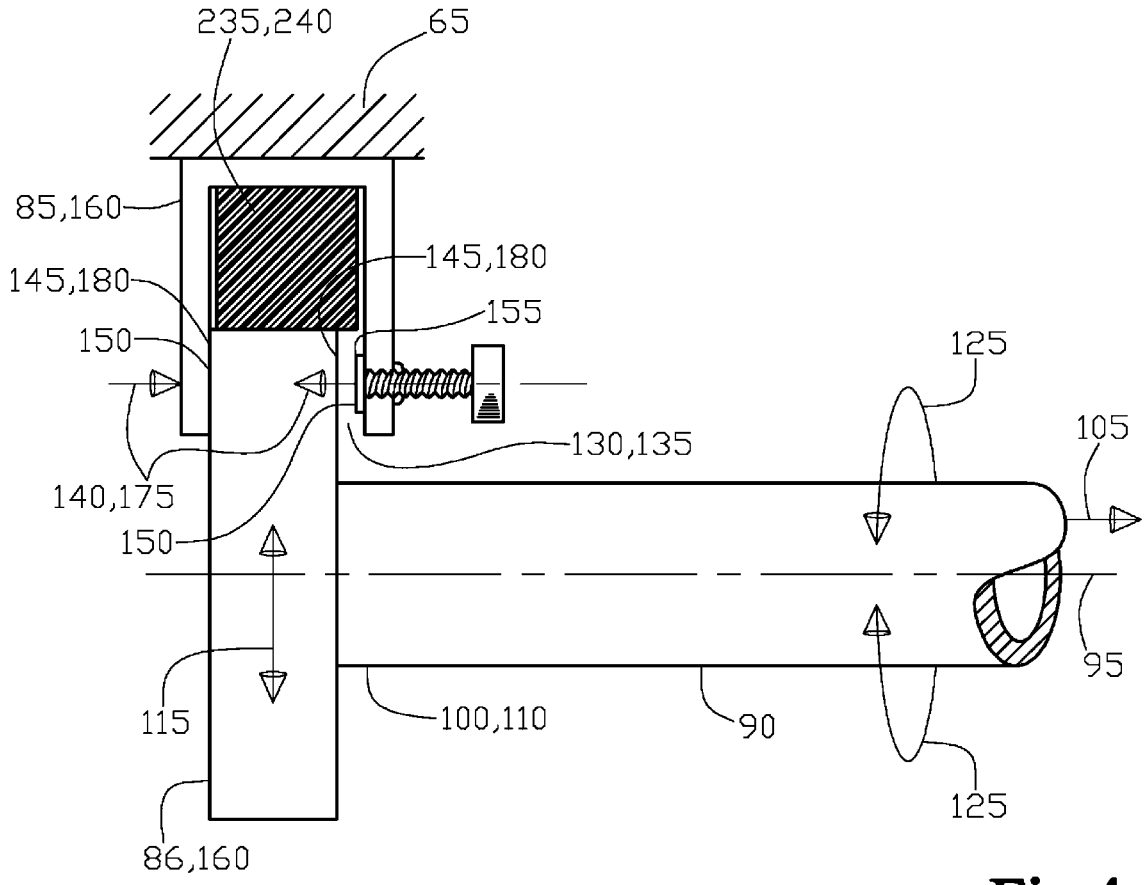
FIG. 4 is an expanded cross sectional view of the omnidirectional movable joint element that utilizes the optionally selectable dampening element of the plurality of adjacent surfaces that are compressed as against one another by selectable compressive force levels, wherein dampening is provided for both the omnidirectional movement and the arm rotational movement, in addition to the elastomeric material for the means for urging the grasping arm into a centered operational state.
Figure 5:
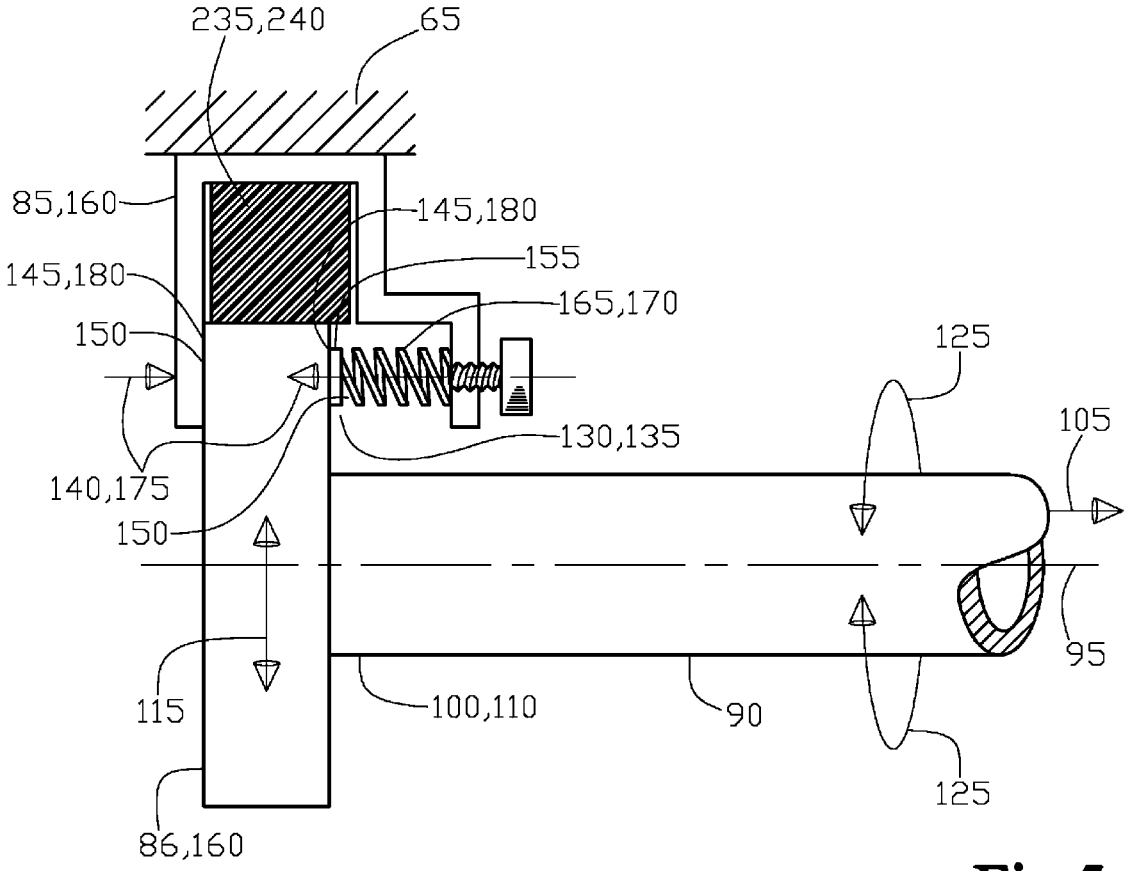
FIG. 5 is an expanded cross sectional view of the omnidirectional movable joint element that utilizes the optionally adjustable spring element dampening element of the plurality of adjacent surfaces that are compressed as against one another by selectable compressive force levels, wherein dampening is provided for both the omnidirectional movement and the arm rotational movement, in addition to the elastomeric material for the means for urging the grasping arm into a centered operational state.

Continuing, FIG. 4 is an expanded cross sectional view of the omnidirectional movable joint element 85 that utilizes the optionally selectable dampening element 135 of the plurality of adjacent surfaces 145 that are compressed as against one another by selectable compressive force 140 levels, wherein dampening is provided for both the omnidirectional movement 115 and the arm rotational movement 125, in addition to the elastomeric material 240 for the means 235 for urging the grasping arm 90 into a centered operational state. Further, FIG. 5 is an expanded cross sectional view of the omnidirectional movable joint element 85 that utilizes the optionally adjustable spring element 165 for the dampening element 135 of the plurality of adjacent surfaces 145 that are compressed as against one another by selectable compressive force 140 levels, wherein dampening is provided for both the omnidirectional movement 115 and the arm rotational movement 125, in addition to the elastomeric material 240 for the means 235 for urging the grasping arm 90 into a centered operational state.

Figure 6:
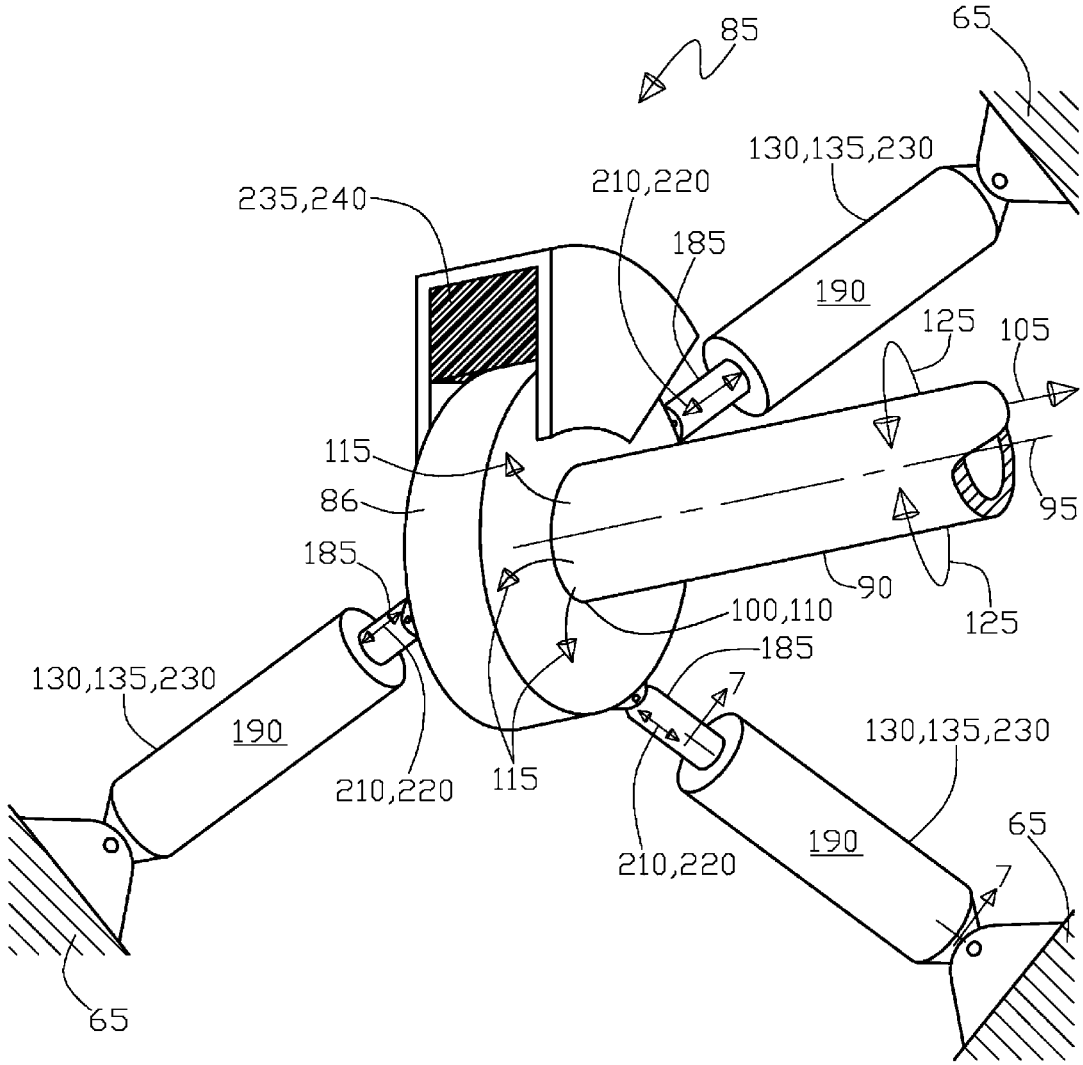
FIG. 6 is an expanded perspective view of the omnidirectional movable joint element that utilizes the optionally selectable dampening element of the plurality of axial movement piston within the cylinder arrangements, in addition to the elastomeric material for the means for urging the grasping arm into a centered operational state, wherein dampening is provided both for the omnidirectional movement and the rotational movement.
Figure 7:
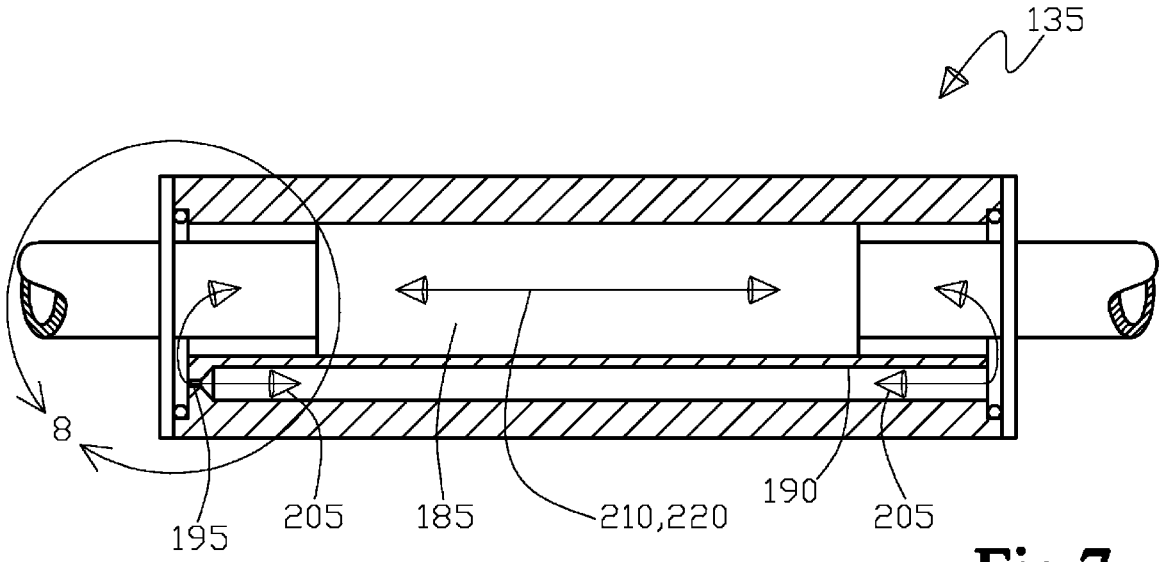
FIG. 7 is cross sectional view 7-7 from FIG. 6 that shows the dampening element for one of the piston and cylinder assemblies with the restriction orifice, piston movement, and the flow of the fluid that provides for viscous dampening that is equal in both piston movement directions.
Figure 8:
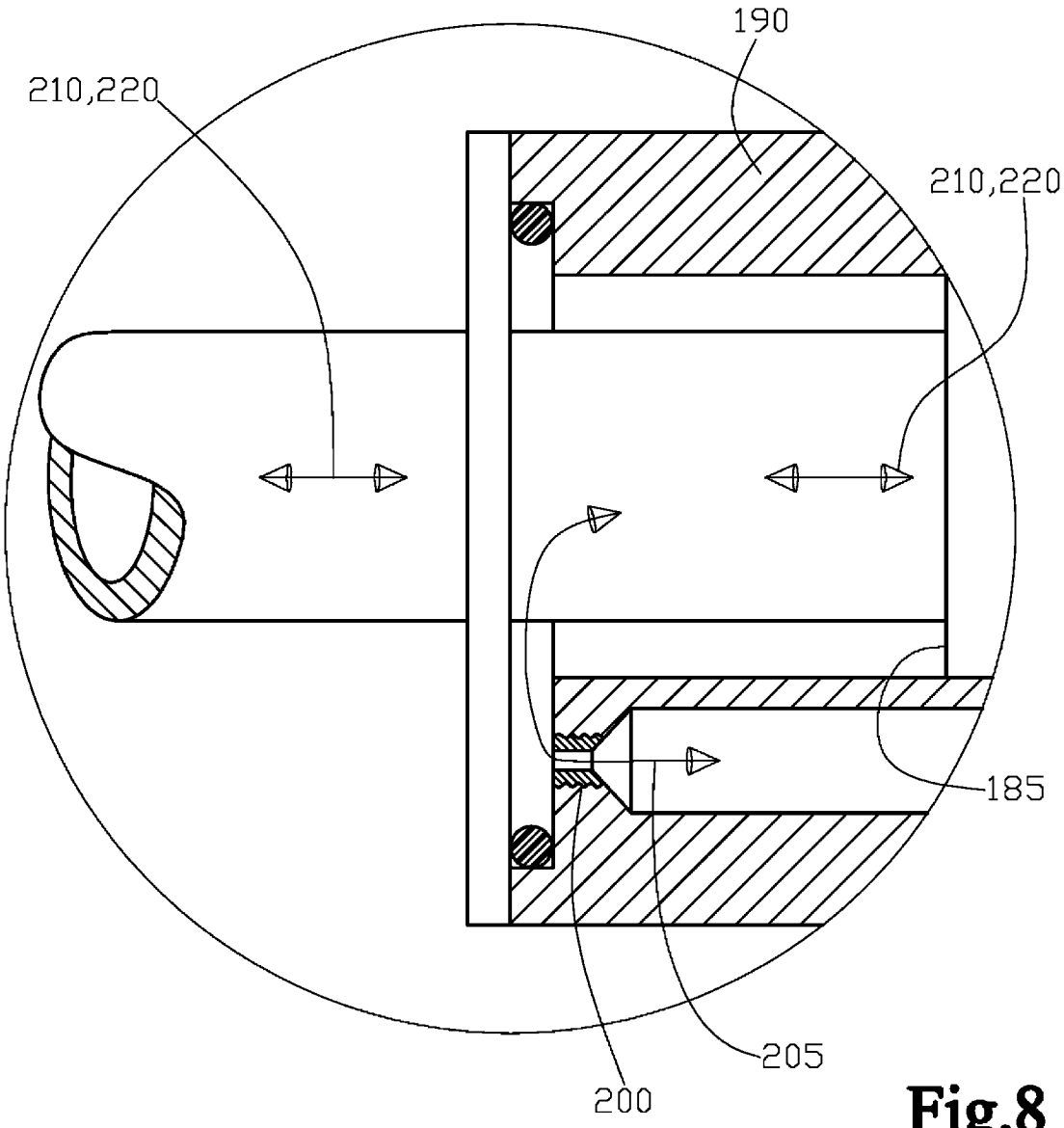
FIG. 8 shows expanded view 8-8 from FIG. 7 that shows the dampening element for an end portion of one of the piston and cylinder assemblies with the selectively variable restriction orifice, piston movement, and the flow of the fluid that provides for viscous dampening.

Continuing, FIG. 6 is an expanded perspective view of the omnidirectional movable joint element 85 that utilizes the optionally selectable dampening element 135 of the plurality 230 of axial movement 220 piston 185 within the cylinder 190 arrangements, in addition to the elastomeric material 240 for the means 235 for urging the grasping arm 90 into a centered operational state, wherein dampening is provided both for the omnidirectional movement 115 and the rotational movement 125. Next, FIG. 7 is cross sectional view 7-7 from FIG. 6 that shows the dampening element 135 for one of the piston 185 and cylinder 190 assemblies with the restriction orifice 195, piston movement 210, and the flow of the fluid 205 that provides for viscous dampening that is equal in both piston movement 210 directions. Also, FIG. 8 shows an expanded view 8-8 from FIG. 7 that shows the dampening element 135 for an end portion of one of the piston 185 and cylinder 190 assemblies with the selectively variable restriction orifice 200, piston movement 210, and the flow of the fluid 205 that provides for viscous dampening.

Figure 10:
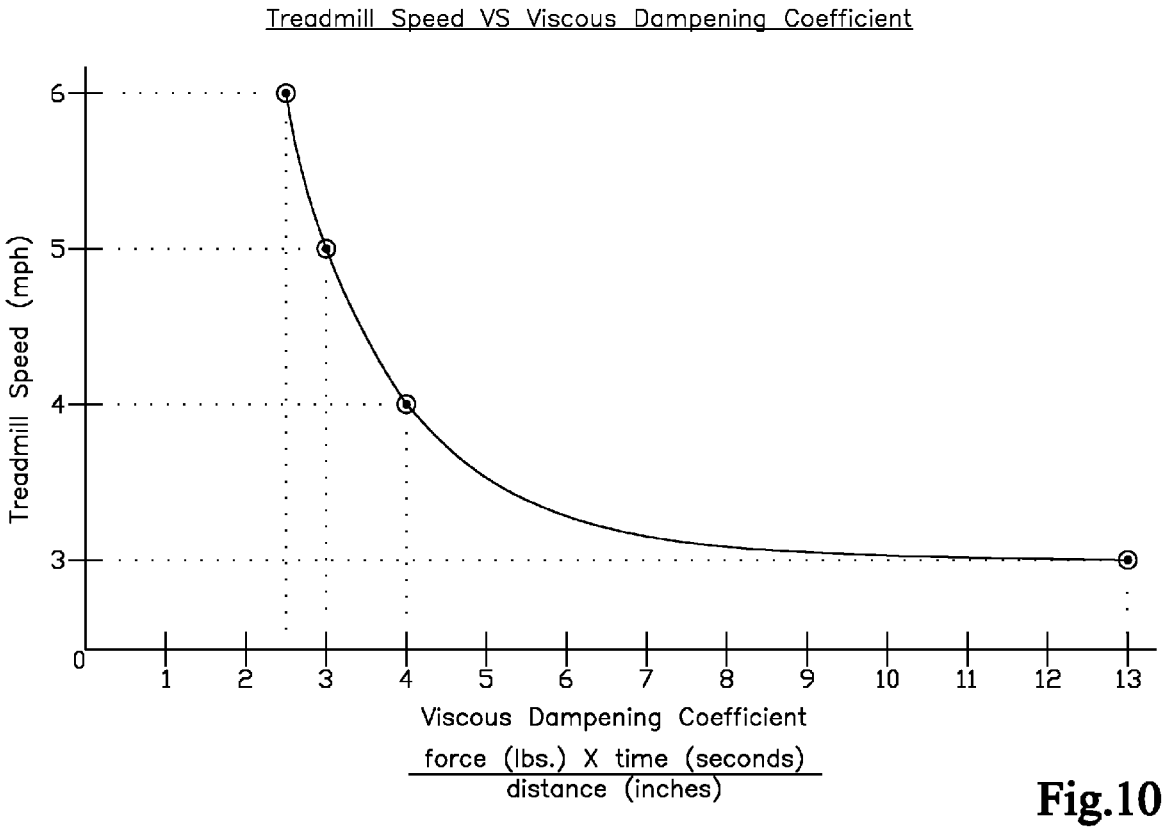
FIG. 10 is the reduction of raw data from FIG. 9 into a curve showing the change of the viscous dampening coefficient with changes in treadmill moving surface speed.
Figure 11:
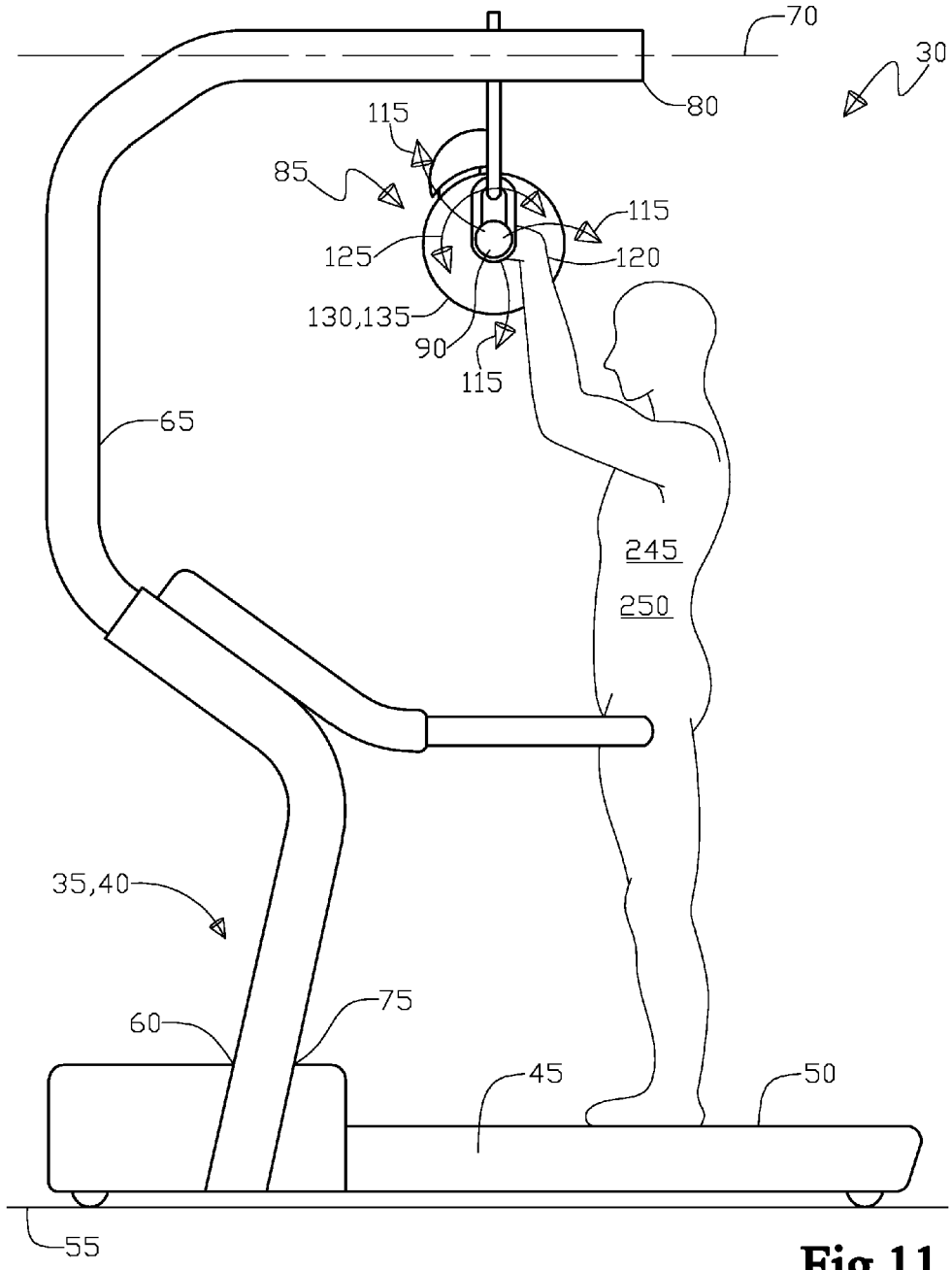
FIG. 11 is an elevation view of the exercise apparatus showing the treadmill, support beams, omnidirectional movable joint element, and the grasping arm, with the user in position to start using the exercise apparatus that is adapted for use with a treadmill.

Yet further, FIG. 9 is a raw data chart for test data utilizing the treadmill 40 (not shown) with the same user 250 (not shown) at various treadmill 40 moving surface 50 speeds, wherein viscous dampening coefficient component data was taken for the three attributes of force to move the arm 90 (not shown), distance that the arm 90 moves, and the amount of time it takes the arm 90 to move the specified distance. Continuing, FIG. 10 is the reduction of raw data from FIG. 9 into a curve showing the change of the viscous dampening coefficient with changes in treadmill 40 (not shown) moving surface 50 (not shown) speed. Next, FIG. 11 is an elevation view of the exercise apparatus 30 showing the treadmill 40, support beams 65, omnidirectional movable joint element 85, and the grasping arm 90, with the user 250 in position to start using the exercise apparatus 30 that is adapted for use with a treadmill 40. Next, FIG. 12 is an elevation view of the exercise apparatus 30 showing the treadmill 40, support beams 65, omnidirectional movable joint element 85, and the grasping arm 90, with the user 250 in a running operational state in using the exercise apparatus 30 that is adapted for use with a treadmill 40.

In looking at the FIGS. 1 through 8, the current invention is of an exercise apparatus 30 that is adapted for use with a leg exercising machine 35 on a surface 55, with the exercise apparatus 30 including a base 60, a support beam 65 having a longitudinal axis 70, with the support beam 65 including a proximal end portion 75 and an opposing distal end portion 80 with the longitudinal axis 70 disposed between the proximal 75 and distal 80 end portions, wherein the proximal end portion 75 extends from the base 60. Further included in the exercise apparatus 30 is an omni-directional movable joint element 85, as best detailed in FIGS. 3 through 8, that is disposed adjacent to the distal end portion 80 of the support beam 65 and a grasping arm 90 having a lengthwise axis 95, with the grasping arm 90 being received within the omnidirectional movable joint element 85. Wherein, the grasping arm 90 is operational to have omni-directional movement 115 relative to the support beam 65. The leg exercising machine 35 is typically a treadmill apparatus 40 that includes a treadmill frame 45 and a treadmill moving surface 50, with the treadmill disposed upon a surface 55, as shown in FIG. 1. However, the leg exercising machine could be any number of leg exercising machines 35 such as an elliptical machine, a stair stepper, ski machine, and the like.

Figure 12:
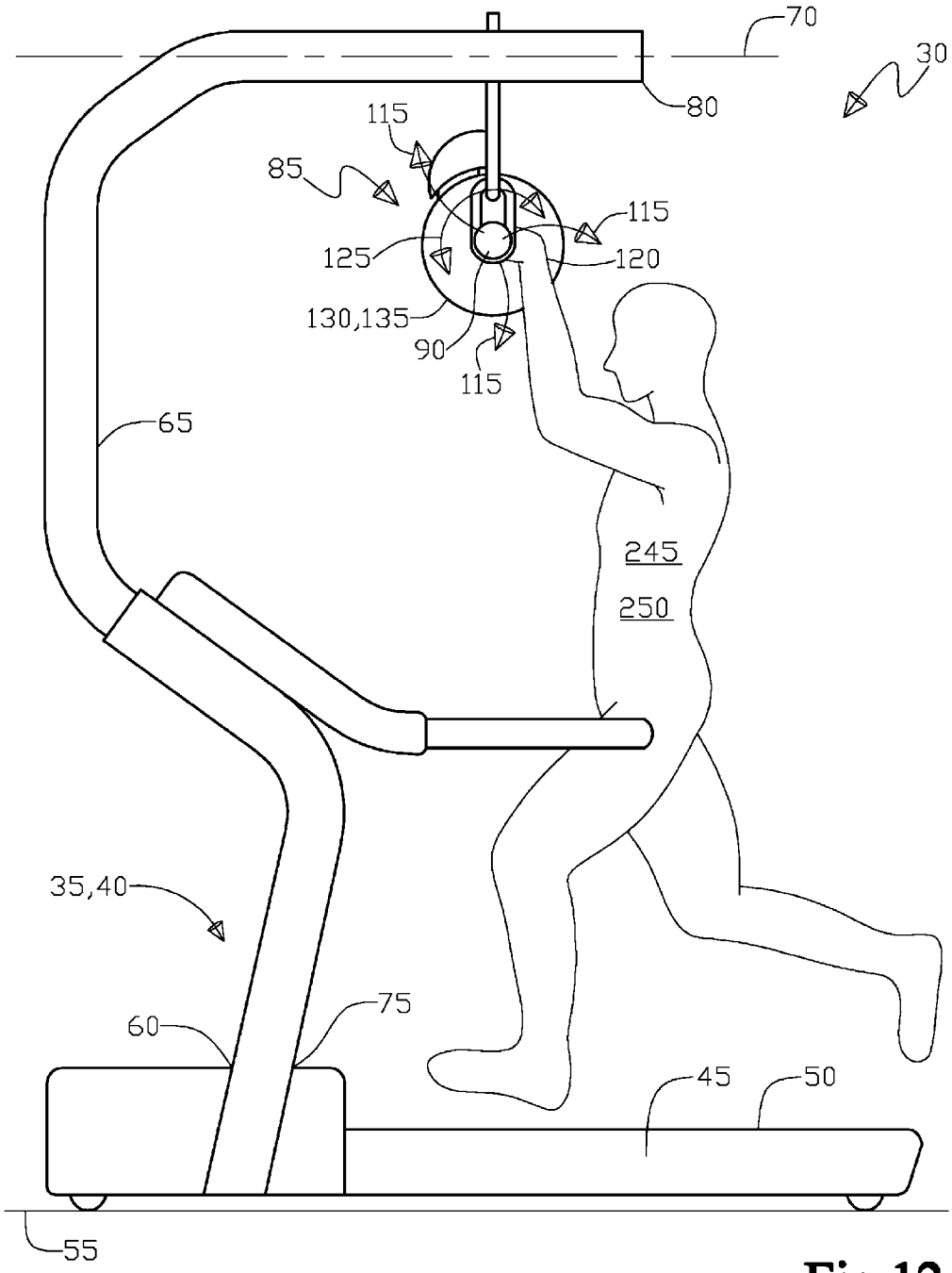
FIG. 12 is an elevation view of the exercise apparatus showing the treadmill, support beams, omnidirectional movable joint element, and the grasping arm, with the user in a running operational state in using the exercise apparatus that is adapted for use with a treadmill.

Also included in the exercise apparatus 30 is a dampening element 135 that is disposed as between the support beam 65 and the grasping arm 90, wherein the dampening element 135 is operational to dampen the omnidirectional movement 115 as between the grasping arm 90 and the support beam 65, as best shown in FIGS. 3 through 6, such that an individual 245 using the leg exercising machine 35 can grasp 120 the arm 90 for stability and support to effect a soft skeletal joint support that is variable at will on whether to grasp 120 the arm 90 or not, as shown in FIGS. 11 and 12. Dampening being defined as the forcible movement of a mass through a distance within a certain amount of time, such that the units are (pounds [force]–seconds [time]) per inch [distance], termed the "viscous dampening coefficient". Dampening in a mechanical sense is commonly associated with a theoretical spring and mass system that has an un-damped frequency (i.e. assuming ideally that there is no friction) such that the spring and mass system would oscillate at its un-damped frequency perpetually, however, in the real world of course the mass would eventually stop oscillating due to hysteresis within the system and other frictions external to the system.

With the exercise apparatus 30 being used with a treadmill 40, a pair of support beams 65 is used with each beam 65 having a longitudinal axis 70, with each support beam 65 including a proximal end portion 75 and an opposing distal end portion 80 with the longitudinal axis 70 disposed between the proximal 75 and distal 80 end portions, wherein the proximal end portion 75 extends from the treadmill frame 45, see FIGS. 1 and 2. Further included in the exercise apparatus 30 used with a treadmill 40 is a pair of omni-directional movable joint elements 85 that are each disposed adjacent to each of the distal end portions 80 of the support beams 65 wherein the omni-directional movable joint elements 85 can also incorporate the dampening elements 135 and can also incorporate the dampening units 130. Also a grasping arm 90 having a lengthwise axis 95, with the grasping arm having an end portion 100 and an opposing end portion 105 with the grasping arm 90 being received 110 on each of the end portions 100 and 105 within the omni-directional movable joint element 85, wherein the arm 90 is positioned therebetween the pair of omni-directional movable joint elements 85 or as between the pair of beam distal end portions 80, see FIG. 1. Wherein, the grasping arm 90 is operational to have omni-directional movement 115 relative to the support beams 65.

Also included in the exercise apparatus 30 that is used with a treadmill 40 is a pair of dampening elements 135 that are each disposed as between each one of the support beams 65 and the grasping arm 90, wherein the dampening elements 135 are operational to dampen the omnidirectional movement 115 as between the grasping arm 90 and the support beams 65 such that an individual 245 using the treadmill 40 can grasp 120 the arm 90 for stability and support to effect a soft skeletal joint support that is variable at will on whether to grasp 120 the arm 90 or not, see FIGS. 3 through 6, plus 11 and 12. Dampening being defined as the forcible movement of a mass through a distance within a certain amount of time, such that the units are (pounds [force]–seconds [time]) per inch [distance], termed the viscous dampening coefficient. Dampening in a mechanical sense is commonly associated with a theoretical spring and mass system that has an un-damped frequency (i.e. assuming ideally that there is no friction) such that the spring and mass system would oscillate at its un-damped frequency perpetually, however, in the real world of course the mass would eventually stop oscillating due to hysteresis within the system and other frictions external to the system.

Frequently in mechanics there is a desire to control the dampening effect to bring the oscillating spring and mass into a static state in a selected amount of time for various reasons wherein excessive movement of the spring and mass system would be undesirable, with the most typical example being the common automobile wheel, spring, and shock absorber system. For the automobile, the wheel and spring assembly absorb shock from say potholes in the road surface so that the movement that the wheel experiences in going into the pothole is not totally transmitted to the automobile structure for passenger comfort, however, the undesirable side effect is that when the automobile comes to a stop in a block or so for a stop light, the automobile structure will continue to move or oscillate due to the stored spring energy, thus this is where the shock absorber comes into play as the dampener for the wheel and spring system, thus the shock absorber in operational to considerably reduce or dissipate the stored spring energy to reduce automobile structure movement to an acceptable level, as this would be considered the benefit of conventional dampening, which is used in many difference types of devices in addition to the automobile example given, such as camera mounts, electronics, test instruments, and so on.

In the present invention, the function of dampening is different, wherein the exercise apparatus 30 is not a spring and mass system, wherein we are not trying to dissipate stored spring energy that results in undesirable movement as is traditionally done with a spring, mass, and damper system, that has the functions of dampening levels of over-damped, under-damped, and critically damped systems whereas these dampening levels relate to how quickly the spring and mass system is brought into a static state from an oscillating state. The present invention alternatively uses dampening as a measure of control for skeletal loading of the user 250 while on the leg exercising machine, thus as the user 250 grabs 120 the grasping bar 90, that are not only taking a gravitational load off of their feet, ankles, knees, hips, back, and so on, and also adding a measure of stability to the user, allowing then to push themselves to a higher degree for leg exercising machine 35 speed and/or endurance without fear of losing their balance while pushing themselves on the leg exercising machine 35, plus reducing the user's 250 fatigue in their feet, ankles, knees, hips, back, and so on, in addition to furthering the user's 250 safety, as falling from a leg exercising machine 35 or treadmill 40 can be dangerous to the user 250.

Thus in the present invention, when the user 250 grabs 120 the bar 90, to make for a more comfortable support especially relating to the user's 250 hands, wrists, elbows, and shoulders, the bar 90 is movable in a damped fashion through the bar's 90 omnidirectional movement 115 to give the bar 90 a cushioned feel to the user 250. Further, the user 250 can use the dampened bar 90 movement 115 to perform upper body exercises against through movement 115. Thus, as opposed to a spring and mass system, the user 250 provides the force through grabbing 120 the bar 90 as against the damper element 135 to make their (the user 250) leg exercise machine 35 workout more intense and effective in pushing the leg exercise machine 35 time and speed levels higher with having more safety.

The aforementioned force from the user 250 (resulting in movement 115) comes from a combination of the user's 250 body weight, their counteractive body force from the leg exercise machine 35 (for instance on a treadmill 40 which pulls the user 250 backward with the user 250 by running/walking counteracting with forward force-however the backward and forward forces are not always in perfect balance), and the destabilizing effects upon the user from the leg exercising machine 35. Again being on a treadmill 40, upsets the normal counterbalancing torso and arm pendulum pacing effect when the user 250 is running/walking on a static surface-like a running track or sidewalk, i.e. it is a more natural whole body balance for instance when running on a conventional static surface than compared to running on a treadmill 40, which requires more user 250 effort at keeping their balance—this is why an hour on a treadmill 40 is more wearing on a user 250 than a comparable hour on a static surface running track for the user 250. This is because on a static surface the user 50 runner can utilize all manner of kinematic compensatory moves to enhance balance on a static surface such as leg speed, foot placement (both in running stride length and tracking stride width), plus larger movements of the user 250 runner torso and arms. This as compared to a treadmill 40 for instance, wherein foot placement is more confined due to no instantaneous change in speed available (due to short term unchanging treadmill moving surface 50 speed) and limited moving surface 50 length (thus the stride width is fixed) and limited tracking change (stride width) ability due to the treadmill 40 width, wherein the limited width and length of the treadmill 40 also limits the use of the runner's torso and arms for counterbalancing effect.

Referring to the dampening test data chart in FIG. 9 the preferred dampening rates are shown for various speeds of the treadmill 40 moving surface 50 that is suspended in the treadmill frame 45, as this chart shows the raw test data that can be converted into a series of preferred viscous dampening coefficients in the units of force-time per distance or pounds force multiplied by seconds with that quantity divided by distance in inches. The treadmill 40 speed is self explanatory, the force was the for applied as against the bar 90 from the previously described centered operational state of the bar 90, the movement-max is how far the bar 90 moved from the centered operational state at its furthest point, and the time is the amount of time it took to move the bar 90 the distance from the centered operational state. Note that for consistency, a single same user 250 performed all of the tests. Thus for a 3 mph speed the preferred viscous dampening coefficient is 13.32. For the 4 mph speed the preferred viscous dampening coefficient is 4.1. For the 5 mph speed the preferred viscous dampening coefficient is 3.03. For the 6 mph speed the preferred viscous dampening coefficient is 2.4. This results in an aggregate mean of 4.43 for the viscous dampening coefficient.

Thus as shown in FIG. 9 the viscous dampening coefficient goes downward with increased treadmill 40 speed, in looking at the raw data it can be seen that the force and movement or distance both went upward with speed which one would expect as the user 250 instability would increase with speed, however, the time component went downward with speed, so that in looking at the viscous dampening coefficient units, the force and distance are going up together with speed would have a minor effect as the force is in the numerator and the distance is in the denominator, so the major influence is in the time factor that went downward with speed, wherein time is in the numerator, thus the time component is responsible for the drop in the viscous dampening coefficient as speed increased. This being somewhat anti-intuitive as one would think higher speeds would lead to higher dampening being required for bar 90 movement 115, however, quite the opposite is true wherein lower dampening is required at higher speeds primarily due to the higher frequency at which the bar 90 moves. Therefore in conclusion, based upon the test data in FIG. 9 the higher the treadmill 40 speed the lower the viscous dampening coefficient is preferably to be for a single user 250.

There are numerous ways in which to actually dampen a system and to urge the system into a preferred positional state which are described as follows. As an option, the exercise apparatus 30 can further comprise a means 235 for urging the grasping arm 90 to a centered operational state within the omni-directional movable joint element 85, see FIGS. 3 through 6. Continuing, on the means 235 for the exercise apparatus 30 the means 235 for urging the grasping arm 90 to a centered operational state within the omni-directional movable joint element 85 with the means 235 typically constructed of an elastomeric element 240. Wherein the centered operational state is defined as a position of the grasping arm 90 within the omni-directional movable joint element 85 wherein the allowable omnidirectional movement 115 is at its maximum in all directions simultaneously, thus the grasping arm 90 is centered within the omni-directional movable joint element 85 allowable movement 115 as the centered operational state.

Further, on the dampening element 135 of the exercise apparatus 30 the dampening element 135 can be constructed by applying a force 140 compressing a plurality of surfaces 145 to one another so as to have a dynamic coefficient of friction 180 between the plurality of surfaces 145 that have a movement 150 relative to one another, wherein the control of movement between the plurality of surfaces 145 results in a control of the dampening element 135 movement, as best shown in FIGS. 4 and 5. Further, on the dampening element 135 of the exercise apparatus 30 wherein the dampening element 135 plurality of surfaces 145 includes a sacrificial friction disc 155 adjacent to a hard disc 160 and a spring element 165 to maintain a substantially constant compressing force 140 as the friction disc 155 wears by thinning or losing material axially, see FIG. 5. Thus the spring 165 is operational to maintain the substantially constant compressing force 140 further resulting in a substantially constant viscous dampening coefficient as the force factor is held constant of the viscous dampening coefficient equation as previously described, assuming that the distance and time factors are relatively constant, as are the materials and face surfaces that are in contact with one another at the relative movement 150 location of the surfaces, such that the coefficient of friction being dynamic 180 as the surfaces are moving in relation to one another. In addition, the spring element 170 can be selectively adjustable to enable the force factor 175 of the viscous dampening coefficient as previously described to be altered if desired, further the dampening element 135 can also be selectively adjustable via a thumb screw to enable the force factor 175 of the viscous dampening coefficient as previously described to be altered if desired, see FIGS. 4 and 5.

Continuing, on the dampening element 135, for the exercise apparatus 30 wherein the selectively adjustable dampening element 135 accomplishes dampening adjustment by a selectively variable force 140 compressing a plurality of surfaces 145 to one another to vary the normal force so as to vary the viscous dampening coefficient between the plurality of surfaces 145 that have movement 150 relative to one another, which results in varying the force factor in the viscous dampening coefficient as previously described, again best shown in FIGS. 4 and 5. Wherein the control of movement 150 between the plurality of surfaces 145 results in control of the dampening element 135 movement. Also optionally, for the exercise apparatus 30 the dampening element plurality of surfaces 145 includes a sacrificial friction disc 155 adjacent to a hard disc 160 and a selectively adjustable spring element 165 or non spring version adjustment thumbscrew, see FIG. 4, to create the selectively variable compressing force 140 to ultimately vary the viscous dampening coefficient as previously described.

As an alternative for the dampening element 135 for the exercise apparatus 30 wherein the dampening element 135 accomplishes dampening by construction of a piston 185 and cylinder 190 type utilizing a restriction orifice 195 to control the flow of a fluid 205 from the piston 185 and cylinder 190 to control a movement 210 of the piston 185 in relation to the cylinder 190, see FIG. 3, and FIGS. 6 through 8. Wherein the control of movement between the piston 185 in relation to the cylinder 190 results in a control of the dampening element 135 movement. Further, there are several ways in which to size and configure the piston 185 and cylinder 190 type dampening element 135, depending on whether the piston 185 movement is axial 220, see FIGS. 6 through 8, or radial 225, see FIG. 3, in nature in relation to the cylinder 190. In the axial 220 piston 185 movement case the piston 185 has movement axially 220 within cylinder 190, wherein a plurality 230 of piston 185 and cylinder 190 arrangements are used as shown in FIG. 6 that are pivotally attached so as to dampen movement of the bar 90 omni-directionally 115. On the radial 225 piston 185 movement arrangement for the exercise apparatus 30 the piston 185 has movement radially 225 within the cylinder 190 as shown in FIG. 3. Note that for the dampening element 135, the dampening unit 130, and the means 235 for urging the grasping arm 90, all as shown in FIGS. 3 through 6, only a radial segment is shown for pictorial clarity, wherein the element 135, unit 130, and means 235 could all circumferentially encase the omnidirectional movable joint element 85 or disc 86 as required for function.

Further, on the piston 185 and cylinder 190 selectively adjustable dampening element 135, it accomplishes dampening adjustment with the piston 185 and cylinder 190 type utilizing a selectively variable restriction orifice 200 to control the flow of a fluid 205 from the piston 185 and cylinder 190 to control a movement 210 of the piston 185 in relation to the cylinder 190, see FIGS. 3, 7, and 8. Wherein the control of movement between the piston 185 in relation to the cylinder 190 results in a control of the dampening element movement 115 from the bar 90 see FIGS. 3 and 6. Note that the selectively adjustable dampening element 135, that accomplishes dampening adjustment with the piston 185 and cylinder 190 type utilizing a selectively variable restriction orifice 200 can apply equally well to either the axial piston 185 movement 220, see FIGS. 6, 7, and 8, plus the radial piston 185 movement 225, see FIG. 3, as in either case the piston 185 moves the fluid 205 through the orifice 195 and 200 by virtue of the cylinder 190 basically to alter the force factor in the viscous dampening coefficient equation as previously defined.

Another option, on the exercise apparatus 30 the grasping arm 90 can be sized and configured to further include rotating movement 125 about the lengthwise axis 95 relative to the omni-directional movable joint element 85, see FIGS. 3 and 6. Further, to the optional rotational movement 125 for the arm 90, there can be added a dampening unit 130 that is operational to dampen the rotating movement 125 utilizing the same units as the dampening element 135 being the viscous dampening coefficient as previously described, see FIGS. 4, 5, and 6. Further, to the dampening unit 130 of the exercise apparatus 30 the dampening unit 130 is constructed of a plurality 230 of axial movement 220 piston 185 and cylinder 190 assemblies each utilizing a restriction orifice 195 to control the flow of a fluid 205 from each piston 185 and cylinder 190 to control a movement 220 of each piston 185 in relation to each cylinder 190. See FIGS. 6, 7, and 8. Wherein, control of movement 220 between each piston 185 in relation to each cylinder 190 results in a control of the dampening rotating movement 125, see FIG. 6. Note that for the dampening unit 130 for dampening rotational movement 125 of the arm 90 that dampening arrangements that work are the previously described plurality 230 of axial movement 220 piston 185 and cylinder 190 assemblies and the plurality of surfaces dampening element 145 as shown in FIG. 6.

Method of Use

Referring in particular to FIGS. 11 and 12, a method of using an exercise apparatus 30 that is adapted to attach to a treadmill 40 is disclosed that starts by comprising the steps of firstly providing a treadmill apparatus that includes a treadmill frame and a treadmill moving surface, secondly, by providing an exercise apparatus as previously described. Next, a step of adjusting selectively the dampening elements 135 via the viscous dampening coefficient to coincide with a selected speed on the treadmill moving surface 50, such that as the selected speed increases of the moving surface 50 of the treadmill 40 there is an inverse relationship with the viscous dampening coefficient decreasing while the selected speed increases of the moving surface 50 increases. A next step is of positioning a user 250 to be standing upon the treadmill moving surface 50, see FIG. 11, and then a further step of activating the treadmill moving surface 50 by turning the treadmill 40 on, see FIG. 12. Continuing, also a step of grasping 120 the grasping arm 90 by the user, see FIGS. 11 and 12. User 250 selectable adjustment of the dampening element 135 is by changing the variable restriction orifice 200, see FIGS. 3, 7, and 8, such that the orifice inside diameter is different, meaning that a smaller orifice 200 inside diameter provides more movement 210 and 220 restriction or requiring more force (component from the viscous dampening coefficient) and conversely a larger inside diameter variable restriction orifice 200 meaning that a larger orifice inside diameter 200 provides less movement 210 and 220 restriction or requiring less force (component from the viscous dampening coefficient). For selective dampening adjustment of the plurality of surfaces 145 dampening element 135, see FIGS. 4 and 5, the compressive force 140 is altered via the thumb screw or an alternative that can alter the compressive force 140 so as to change the frictional force required for relative movement 150 of the plurality of surfaces 145 wherein more compressive force 140 increases the force component (component from the viscous dampening coefficient) and less compressive force 140 decreases the force component (component from the viscous dampening coefficient).

Alternatively, on the method of use for the exercise apparatus 30, focusing on the previous step of adjusting selectively, is further modified to initially adjusting the dampening elements 135 via the viscous dampening coefficient at a walking speed of the treadmill moving surface 50, being from zero speed up to about three and one half (3½) miles per hour (mph) such that the walking speed equals an initial viscous dampening coefficient that is a value that coincides with the user 250 striding pace frequency for a distance and a time component of the omnidirectional movement. The user 250 striding pace frequency is defined as a single cycle of one of the user's 250 legs going through one complete motion being from the user's 250 foot being directly below their hip to going to the maximum forward movement to the maximum rearward movement and returning to the user's 250 foot being directly under their hip. Further as the user's two legs move in opposite cadence or in other words the user's leg cycles move oppositely of one another for ambulatory balance, such that one leg is at the maximum forward movement and the other leg is at the maximum rearward movement simultaneously, this results in the actual striding pace frequency being two times (2×) the frequency of a single user's 250 leg going through one complete cycle as previously defined, this is primarily due to the user's 250 torso oscillating vertically upward when either the left or right foot passes underneath their hips and then the user's 250 torso oscillating vertically downward as their right and left root are at their respective maximum forward and maximum rearward movements with the process repeat in an opposite position for the right and left feet maximum rearward and maximum forward movements.

Thus as far as the viscous dampening coefficient goes, with the user 250 in the previous step determining the hertz from the at walking speed on the treadmill 40 from the previous description they have the time component determined for the viscous dampening coefficient, with the distance and force components to be determined. The distance and force components are interrelated in that the distance component is determined via the gait length and leg length of the use 250, wherein long legs and long gait equal more distance and conversely short legs and short gait equal less distance, however, long legs do not necessarily equal a long gait, as someone with long legs could have a sort gait, also someone with short legs could have a long gait. The point of the distance component of the viscous dampening coefficient is to have the grasping arm 90 movement distance component roughly equal to the user's 250 torso movement distance, thus for long treadmill sessions, the separate movement of the user's 250 shoulder, elbow, and wrist joints is minimized to reduce fatigue. As any treadmill user knows on a conventional treadmill, using the fixed position waist level grab bar on the conventional treadmill can result in wrist, elbow, and shoulder fatigue, as the waist level grab bar is totally static or stationary and the conventional treadmill user is quite dynamic in movement of their torso, meaning that the user's wrists, elbows, and shoulders must absorb all of that dynamic torso movement of the user.

This just leaves the force component remaining of the viscous dampening coefficient, wherein the force component is primarily determined from the user's 250 body weight, such that more user 250 body weight equals more force for the force component, from previous testing as shown in FIG. 9, when the same user 250 performed all of the tests who weighed in at two hundred and fifty pounds. As shown in FIG. 9, the force goes up with treadmill moving surface 50 speed increasing. In the aggregate, the force component equaled about one-fifth (⅕) of the user 250 body weight, however, at walking speed the force component equals about one-sixth (⅙) of the user's 250 body weight, and at running speed of the treadmill moving surface 50, being about six miles per hour (mph) the force component equals about one-fourth (¼) of the user's 250 body weight. Thus, for this optional step of setting all of the components of the viscous dampening coefficient being the time, force, and distance components all at walking speed or other speeds as well such as running has been disclosed. Wherein, translating the viscous dampening coefficient components to the present invention is defined by; the time or hertz component is how quickly the grasping arm 90 moves through a cycle of going from its centered operational state (as previously defined) in engaging in the omnidirectional movement 115 and returning to the centered operational state. Further, the force component is the force at which the grasping arm 90 needs to have applied to it to move through the omnidirectional movement 115. Also, the distance component is the distance through which the grasping arm 90 goes through in its omnidirectional movement 115.

For accommodating other treadmill moving surface speed settings of the exercise apparatus 30 another optional step of secondarily selecting a secondary viscous dampening coefficient to be about one-fourth of the initial viscous dampening coefficient for a running speed of the treadmill moving surface, in order to preset the exercise apparatus 30 for higher treadmill moving surface 50 speeds and the associated secondary viscous dampening coefficient.

CONCLUSION

Accordingly, the present invention of an exercise apparatus and method of using the same has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

The invention claimed is:

1. An exercise treadmill apparatus that is adapted to provide overhead grasping support for the user, said exercise treadmill apparatus comprising:

(a) an exercise treadmill including a frame and a moving surface;

(b) a pair of support beams each having a longitudinal axis, each said support beam including a proximal end portion and an opposing distal end portion with each said longitudinal axis disposed therebetween, wherein each said proximal end portion extends from said frame;

(c) a pair of omni-directional movable joint elements, wherein each omni-directional movable joint element is disposed adjacent to each said distal end portion of said support beams;

(d) a grasping arm having an end portion and an opposing end portion, wherein each said end portion is received within each said omni-directional movable joint element such that said grasping arm is positioned therebetween said movable joint elements and thus said distal end portions, wherein said grasping arm is operational to have omni-directional movement relative to said pair of support beams; and (e) a pair of dampening elements, wherein each said dampening element is disposed as between each said support beam and said grasping arm being adjacent to each said movable joint element, wherein said dampening elements are operational to dampen said omnidirectional movement as between said grasping arm and said support beams such that an individual using the leg exercising machine can grasp said arm for stability and support to effect a soft skeletal joint support that is variable at will.

2. An exercise apparatus according to claim 1 further comprising a means for urging said grasping arm to a centered operational state within said omni-directional movable joint element.

3. An exercise apparatus according to claim 2 wherein said means for urging said grasping arm to a centered state within said omni-directional movable joint element is constructed of an elastomeric element.

4. An exercise apparatus according to claim 1 wherein said dampening element is constructed by applying a force compressing a plurality of surfaces to one another so as to have a dynamic coefficient of friction between said plurality of surfaces that have a movement relative to one another, wherein said control of movement between said plurality of surfaces results in a control of said dampening element movement.

5. An exercise apparatus according to claim 4 wherein said dampening element plurality of surfaces includes a sacrificial friction disc adjacent to a hard disc and a spring element to maintain a substantially constant said compressing force as said friction disc wears.

6. An exercise apparatus according to claim 1 wherein said dampening element accomplishes dampening by construction of a piston and cylinder type utilizing a restriction orifice to control the flow of a fluid from said piston and cylinder to control a movement of said piston in relation to said cylinder, wherein said control of movement between said piston in relation to said cylinder results in a control of said dampening element movement.

7. An exercise apparatus according to claim 6, wherein said piston and cylinder arrangement is sized and configured to have said piston have said piston movement axially within said cylinder, wherein a plurality of piston and cylinder arrangements are used.

8. An exercise apparatus according to claim 6, wherein said piston and cylinder arrangement is sized and configured to have said piston have said piston movement radially within said cylinder.

9. An exercise apparatus according to claim 1 wherein said dampening element is sized and configured to be selectively adjustable for the dampening units of (pounds force–seconds)/inch, being defined as a viscous dampening coefficient.

10. An exercise apparatus according to claim 9 wherein said selectively adjustable dampening element accomplishes dampening adjustment by a selectively variable force compressing a plurality of surfaces to one another so as to vary said viscous dampening coefficient between said plurality of surfaces that have a movement relative to one another, wherein said control of movement between said plurality of surfaces results in a control of said dampening element movement.

11. An exercise apparatus according to claim 10 wherein said dampening element plurality of surfaces includes a sacrificial friction disc adjacent to a hard disc and a selectively adjustable spring element to create said selectively variable compressing force.

12. An exercise apparatus according to claim 9 wherein said selectively adjustable dampening element accomplishes dampening adjustment by a piston and cylinder type utilizing a selectively variable restriction orifice to control the flow of a fluid from said piston and cylinder to control a movement of said piston in relation to said cylinder, wherein said control of movement between said piston in relation to said cylinder results in a control of said dampening element movement.

13. An exercise apparatus according to claim 12, wherein said piston and cylinder arrangement is sized and configured to have said piston have said piston movement axially within said cylinder, wherein a plurality of piston and cylinder arrangements are used.

14. An exercise apparatus according to claim 12, wherein said piston and cylinder arrangement is sized and configured to have said piston have said piston movement radially within said cylinder.

15. A method of using an exercise apparatus that is adapted to attach to a treadmill comprising the steps of:

(a) providing a treadmill apparatus that includes a treadmill frame and a treadmill moving surface;

(b) providing an exercise apparatus that includes a pair of support beams each having a longitudinal axis, each said support beam including a proximal end portion and an opposing distal end portion with each said longitudinal axis disposed therebetween, wherein each said proximal end portion extends from said frame, further included is a pair of omni-directional movable joint elements, wherein each omni-directional movable joint element is disposed adjacent to each said distal end portion, also included is a grasping arm having an end portion and an opposing end portion, wherein each said end portion is received within each said omni-directional movable joint element such that said grasping arm is positioned therebetween said movable joint elements and thus said proximal end portions, wherein said grasping arm is operational to have omni-directional movement relative to said pair of support beams, and continuing to be included is a pair of selectively adjustable dampening elements that are adjustable via a viscous dampening coefficient, wherein each said dampening element is disposed as between each said support beam and said grasping arm being adjacent to each said movable joint element, wherein said dampening elements are operational to dampen said omnidirectional movement as between said grasping arm and said support beams such that an individual using the leg exercising machine can grasp said arm for stability and support to effect a soft skeletal joint support that is variable at will;

(c) adjusting selectively said dampening elements via said viscous dampening coefficient to coincide with a selected speed on the treadmill moving surface, such that as the selected speed increases there is an inverse relationship with said viscous dampening coefficient decreasing;

(d) positioning a user to be standing upon the treadmill moving surface;

(e) activating the treadmill moving surface; and (f) grasping said grasping arm by the user.

16. A method of using an exercise apparatus according to claim 15, wherein said step of adjusting selectively is further modified to initially adjusting said dampening elements via said viscous dampening coefficient at a walking speed of the treadmill moving surface such that the walking speed equals an initial viscous dampening coefficient is a value that coincides with the user striding pace frequency for a distance and a time component of said omnidirectional movement.

17. A method of using an exercise apparatus according to claim 16 further comprising a step of secondarily selecting a secondary viscous dampening coefficient to be about one-fourth of said initial viscous dampening coefficient for a running speed of the treadmill moving surface.

* * * * *